US011701756B2

(12) United States Patent
Abel

(10) Patent No.: US 11,701,756 B2
(45) Date of Patent: Jul. 18, 2023

(54) SCREWING TOOL

(71) Applicant: Wera Werkzeuge GmbH, Wuppertal (DE)

(72) Inventor: Michael Abel, Radevormwald (DE)

(73) Assignee: Wera Werkzeuge GmbH, Wuppertal (DE)

( * ) Notice: Subject to any disclaimer, the term of this patent is extended or adjusted under 35 U.S.C. 154(b) by 382 days.

(21) Appl. No.: 16/972,643

(22) PCT Filed: Jun. 4, 2019

(86) PCT No.: PCT/EP2019/064394
§ 371 (c)(1),
(2) Date: Dec. 7, 2020

(87) PCT Pub. No.: WO2019/233967
PCT Pub. Date: Dec. 12, 2019

(65) Prior Publication Data

US 2021/0237231 A1 Aug. 5, 2021

(30) Foreign Application Priority Data

Jun. 6, 2018 (DE) ..... 10 2018 113 479.7

(51) Int. Cl.
*B25B 13/16* (2006.01)
*B25B 13/08* (2006.01)
(Continued)

(52) U.S. Cl.
CPC ..... *B25B 13/16* (2013.01); *B25B 13/08* (2013.01)

(58) Field of Classification Search
CPC ..... B25B 13/12; B25B 13/18; B25B 13/16; B25B 13/08
See application file for complete search history.

(56) References Cited

U.S. PATENT DOCUMENTS 2,697,371 A 12/1954 Bowman
2,751,802 A 6/1956 Reuillard
(Continued)

FOREIGN PATENT DOCUMENTS

DE 9404031 U1 5/1994
DE 29708595 U1 8/1997
(Continued)

OTHER PUBLICATIONS

International Serach Report and Written Opinion of the International Searching Authority and Translation; Application No. PCT/EP2019/064394; Completed: Aug. 20, 2019; dated Aug. 28, 2019, 7 Pages.
(Continued)

*Primary Examiner* — David B. Thomas
(74) *Attorney, Agent, or Firm* — Whitmyer IP Group LLC

(57) ABSTRACT

A screwing tool, including an elongate handle which, at each of the two ends thereof, bears a head pivotable about a pivot axis and having two torque transmission flanks in each case and has a force application flank for introducing a force in order to produce a torque on the head remote from the relevant force application flank, wherein, in a pivoting end position of the head, in which a stop of the head lies against a counter stop of the handle, a narrow side of the head functionally directed away from the stop forms an extension of the force application flank. The second head forms an extension of the force application flank and can be used as a hand grip.

5 Claims, 1 Drawing Sheet

(51) Int. Cl.
*B25B 13/12* (2006.01)
*B25B 13/18* (2006.01)

(56) References Cited

U.S. PATENT DOCUMENTS

| | | | | |
|---|---|---|---|---|
| 4,084,456 | A | 4/1978 | Pasbrig | |
| 4,825,731 | A * | 5/1989 | Stojanowski | B25B 13/46 81/111 |
| 5,890,404 | A | 4/1999 | Stojanowski | |
| 6,386,073 | B1 * | 5/2002 | Chen | B25B 13/46 81/99 |
| 7,347,125 | B1 * | 3/2008 | Juieng | B25B 13/14 81/418 |
| 8,733,214 | B2 * | 5/2014 | Hsu | B25B 13/18 81/126 |
| 8,806,988 | B2 * | 8/2014 | Chang | B25B 13/12 81/126 |
| 8,893,587 | B2 * | 11/2014 | Lai | B25B 13/46 81/58 |
| 9,827,652 | B2 * | 11/2017 | Mills | B25B 13/32 |
| 10,350,735 | B2 * | 7/2019 | Hsu | B25B 13/28 |
| 2014/0060262 | A1 | 3/2014 | Hsu | |
| 2014/0069238 | A1 | 3/2014 | Chang | |
| 2016/0375559 | A1 | 12/2016 | Lai | |
| 2017/0165814 | A1 * | 6/2017 | Chern | B25B 13/12 |

FOREIGN PATENT DOCUMENTS

| | | | |
|---|---|---|---|
| DE | 102017108014 | A1 | 10/2017 |
| KR | 2020110008638 | U | 9/2011 |
| WO | 2010002239 | A1 | 1/2010 |
| WO | 2015061608 | A1 | 4/2015 |

OTHER PUBLICATIONS

European Search Report; Application No. 19728659.4; Completed: Dec. 13, 2022; 5 Pages.

* cited by examiner

SCREWING TOOL

TECHNICAL FIELD

The invention pertains to a screwing tool with an elongate handle, which on at least one of its two ends carries a head that is pivotable about a pivot axis and respectively has two torque transmission flanks. The handle has a force application flank for introducing a force in order to generate a torque on the head. The farther the force application flank is spaced apart from the head, the greater the torque exerted upon the head with a constant force.

BACKGROUND

A screwing tool of the above-described type is known from DE 94 04 031 U1. A head having two torque transmission flanks is located on a first end of an elongate handle. The distance between a fixed jaw that is rigidly connected to the head and a movable jaw that is displaceably arranged on the head changes when the head is pivoted relative to the handle about an axis of rotation. Each of the two jaws forms a torque transmission flank. The two torque transmission flanks approach one another when a torque is applied to the head via the handle. A tooth arrangement of the end of the handle engages into a toothed rack arrangement of the movable jaw in order to displace the movable jaw relative to the fixed jaw.

A similar screwing tool is described in DE 10 2017 108 014 A1.

U.S. Pat. No. 2,697,371 describes an open-end wrench with an elongate handle, which respectively carries a head that has a jaw opening and is rigidly connected to the handle on both of its ends.

U.S. Pat. No. 2,751,802 discloses a box wrench, in which two annular bolt head engagement profile sections are respectively arranged on the end of an elongate handle.

The relevant prior art furthermore includes WO 2010/002239 A1.

SUMMARY OF THE INVENTION

The invention is based on the objective of enhancing an initially characterized screwing tool in terms of its use.

This objective is attained with the invention specified in the claims, wherein the dependent claims not only represent advantageous enhancements of the invention specified in the master claim, but also independent solutions for attaining the objective.

The invention initially and essentially proposes a screwing tool, in which a head that is pivotable about a pivot axis is arranged on each end of the handle. The handle forms two force application flanks, to which a force can be applied in order to exert a torque upon the head lying remotely from the force application flank. According to the invention, this force application flank lies adjacent to a proximal head. A narrow side of the head lying proximal to the respective force application flank forms an extension of the force application flank. Each of the two heads has a stop, which in a pivoting end position is supported on a counter stop of the handle. In the pivoting end position, the heads therefore respectively form quasi-rigid extensions of the force application flank, to which a force is applied in order to exert a torque upon the respective other head. The narrow side of the head therefore forms a lever extension that is pivotably associated with the handle and preferably arranged flushly adjacent to the force application flank of the handle. It is particularly proposed that the handle has two opposite broad sides and two opposite narrow sides. The pivot axes, in which the head is coupled to the handle, extend through the ends of the two broad sides. One of the two narrow sides forms the force application flank. Each of the two heads likewise forms two opposing broad sides. The broad sides of the two heads and of the handle preferably extend in parallel planes. The head is arranged so as to be pivotable relative to the handle in the broad side plane. The head may have a fixed jaw and the movable jaw that can be displaced relative to the fixed jaw. The two jaws may form facing torque transmission flanks. The displacement of the movable jaw relative to the fixed jaw takes place in the broad side plane. A back of the fixed jaw forms a narrow side, which in turn forms a supporting flank that is arranged adjacent to the force application flank of the handle without producing a substantial bending point and thereby forms a force arm extension. Each of the two heads has a stop that lies against a counter stop of the handle in a first pivoting end position. It is preferred to provide a spring element that holds the head in the first stopping position. The spring element preferably acts upon the movable jaw in such a way that the distance between the two torque transmission flanks is minimal in the first pivoting end position. The two heads, which respectively are pivotably connected to the handle on the end of the handle, preferably can be distinguished in that the minimal distances between their torque transmission flanks differ from one another in both first pivoting end positions. The two heads are designed in such a way that they can respectively take hold of hexagonal nuts or bolt heads with three or four different widths across flats. The number of widths across flats to be screwed with the screwing tool can be doubled in that the minimal distances between the torque transmission flanks of the two heads differ from one another. The movable jaw is motion-coupled to an arm of the handle in such a way that the distance between the two torque transmission flanks or the distance between the movable jaw and the fixed jaw respectively changes when the head is pivoted relative to the handle. The arm preferably engages on a pressure flank of the movable jaw that is formed by a recess, into which a tooth formed by the arm of the handle engages. In a preferred enhancement of the invention, the two heads can be displaced from the first pivoting end position into a second pivoting end position, in which the distance between the two torque transmission flanks is minimal, in opposite pivoting directions. For example, one of the heads has to be pivoted in the clockwise direction and the other of the two heads has to be pivoted in the counterclockwise direction. The displacement from the first pivoting end position into the second pivoting end position preferably takes place against the restoring force of a spring. In the second pivoting end position, the two torque transmission flanks are spaced apart by a distance that makes it possible to take hold of a hexagonal profile with the respectively greatest width across flats. The maximum distance between the two torque transmission flanks of one head may be smaller than the minimum distance of the two torque transmission flanks of the other head. According to the invention, the second head of the screwing tool, which can be gripped by the hand of the user, forms a handle representing a force introduction point that is spaced apart from the second head by a maximum distance. To this end, it is particularly advantageous if the material thickness of both jaws of the head is greater than the material thickness of the handle and, in particular, if the narrow side of the head is wider than the force application flank formed by the narrow side of the handle.

BRIEF DESCRIPTION OF THE DRAWINGS

An exemplary embodiment of the invention is described below with reference to the attached drawings. In these drawings.

DETAILED DESCRIPTION OF THE INVENTION

Figure 1:
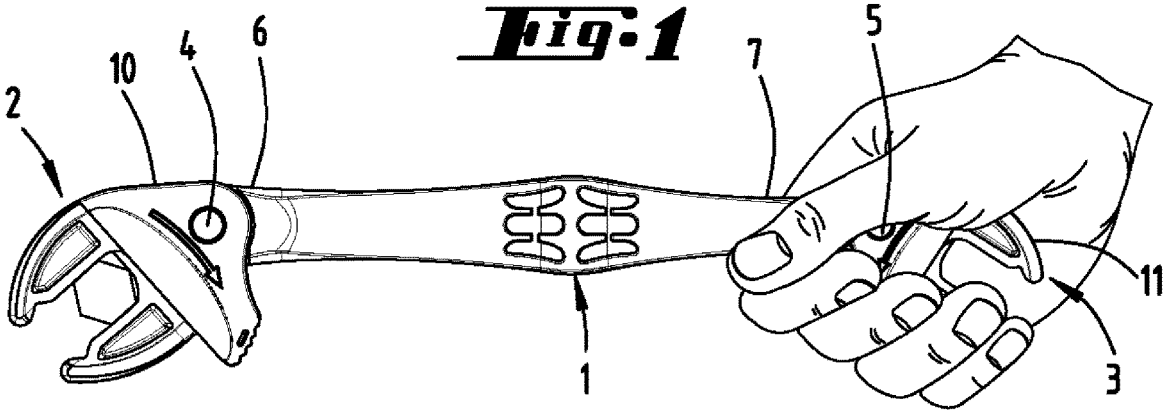
FIG. 1 shows the screwing tool in the form of a broad side view, wherein one head 3 is gripped by the hand of a worker.
Figure 3:
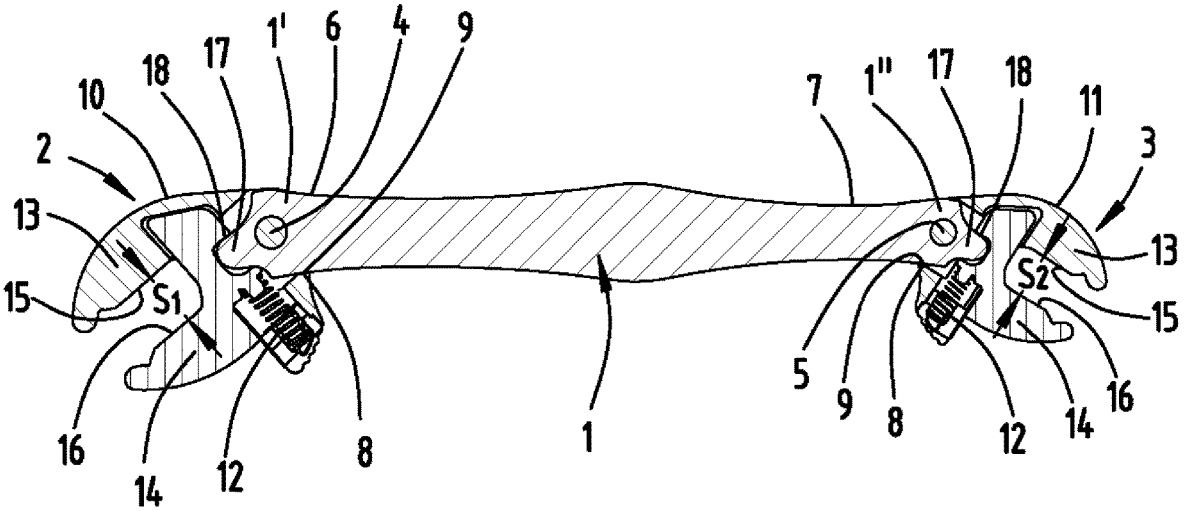
FIG. 3 shows a section through the screwing tool along the line III-III in FIG. 2.

The screwing tool illustrated in the drawings has an elongate handle 1 that is made of steel. The handle 1 has a first end 1' and a second end 1" that lies opposite of the first end. A first head 2 is located on the first end 1' and can be pivoted relative to the handle 1 about a pivot axis 4. The head 2 has a fixed jaw 13 and a movable jaw 14 that can be displaced relative to the fixed jaw 13. The fixed jaw 13 forms a torque transmission flank 15 that is directed toward the movable jaw 14 and the movable jaw 14 forms a torque transmission flank 15 that lies opposite of the torque transmission flank 16.

A tooth space of the movable jaw 14 forms a pressure flank 18, on which a tooth-like arm 17 of the first end 1' of the handle 1 engages. A force acting in the direction of the fixed jaw 13 is applied to the movable jaw 14 by means of a spring 12. The spring 12 holds the head 2 in a first pivoting end position, in which a stop 8 of the head 2 is supported on a counter stop 9 of the handle. The distance S1 between the two torque transmission flanks 15, 16 is minimal in this pivoting end position.

A second head 3 is fastened on the second end 1" of the handle 1 and can be pivoted relative to the handle 1 about a pivot axis 5. The second head 3 has a fixed jaw 13 and a movable jaw 14 that can be displaced relative to the fixed jaw 13. In this case, the two jaws 13, 14 also form facing torque transmission flanks 15, 16 that are spaced apart from one another by a minimal distance S2 in a pivoting end position of the head 3 relative to the handle 1, wherein this minimal distance is smaller than the distance S1 such that the first head 2 can accommodate hexagonal profiles with different widths across flats than the head 3 between the torque transmission flanks 15, 16 in order to exert a torque upon bolts or nuts.

The movable jaw 14 of the second head 3 is acted upon by means of the spring 12 such that a stop 8 of the head 3 lies against a counter stop 9 of the handle 1. A motion coupling between the handle 1 and the movable jaw 14, in which an arm 17 engages on a pressure flank 18 of the head 3, is also provided in this case.

The distance S1 between the two torque transmission flanks 15, 16 increases when the head 2 is pivoted about the pivot axis 4 in the clockwise direction. The distance S1 between the two torque transmission flanks 15, 16 increases when the head 3 is pivoted about the pivot axis 5 in the counterclockwise direction.

The narrow sides of the handle 1 respectively form force application flanks 6, 7 adjacent to one of the two heads 2, 3. In the exemplary embodiment, the force application flanks 6, 7 have a slight concave curvature. The application of a force on the respective force application flanks 6, 7 makes it possible to exert a torque upon the head 2, 3 lying remotely from the respective force application flank 6, 7. The proximal head 2, 3 lying directly adjacent to the force application flank 6, 7 forms an extension of the force application flank 6, 7 with its narrow side 11. The extended force application flank 6, 7 therefore forms a supporting flank that is formed by the narrow side 10, 11 and arranged flushly adjacent to the force application flank 6, 7 formed by the handle 1, i.e. without producing a bending point. The narrow sides 10, 11 forming the supporting flank form convexly extending extensions of the force application flanks 6, 7. In the transition area to the head 2, 3, the concave contour line of the force application flank 6, 7 smoothly transforms into the convexly curved narrow side 10, 11 of the head 2, 3 by forming a reversing point.

Figure 2:
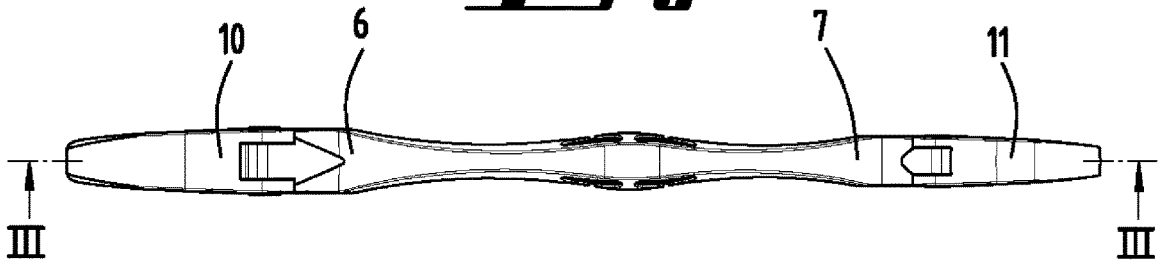
FIG. 2 shows the screwing tool in the form of a narrow side view.

According to FIG. 2, the two narrow sides 10, 11 lie adjacent to the force application flanks 6, 7 with an approximately constant narrow side width in order to thereby form an enlarged pressure surface, which can be acted upon by the ball of the thumb of the user's hand during the actuation of the screwing tool. The user can accommodate one of the two heads 2, 3 in the hollow of the hand during the application of the torque, wherein the ball of the thumb is supported on the narrow side 10, 11. The bend between index finger and thumb may lie in the convexly extending force application flank 6, 7 in this case.

It is particularly advantageous if the transition area between the extended force application flanks 6, 7 formed by the head 2, 3 transforms into the force application flanks 6, 7 formed by the handle in an essentially linear manner. The two surface sections of the adjacent force application flanks 6, 7 of the handle 1 and of the head 2, 3 lie flushly against one another in the transition area. No bending point and no step is formed on the force application flank 6, 7 in the transition area between the lateral surface of the handle 1 and the lateral surface of the head 2, 3.

The preceding explanations serve for elucidating all inventions that are included in this application and respectively enhance the prior art independently with at least the following combinations of characteristics, wherein two, multiple or all of these combinations of characteristics may also be combined with one another, namely:

A screwing tool with an elongate handle 1, which on each of its two ends 1', 1" carries a head 2, 3 that is pivotable about a pivot axis 4, 5 and respectively has two torque transmission flanks 15, 16, wherein said handle has a force application flank 6, 7 for introducing a force in order to generate a torque on the head 2, 3 lying remotely from the respective force application flank 6, 7, and wherein a narrow side 10, 11 of the head 2, 3, which is functionally directed away from a stop 8, forms an extension of the force application flank 6, 7 in a pivoting end position of the head 2, 3, in which the stop 8 of the head 2, 3 lies against a counter stop 9 of the handle 1.

A screwing tool, which is characterized in that the narrow side 10, 11 essentially lies flushly adjacent to the force application flank 6, 7.

A screwing tool, which is characterized in that the head 2, 3 is held in the pivoting end position by means of a spring 12.

A screwing tool, which is characterized in that the two force application flanks 6, 7 are formed by the same narrow side of the handle 1.

A screwing tool, which is characterized by a fixed jaw 13 that is rigidly arranged on the head 2, 3 and a movable jaw 14 that is displaced relative to the fixed jaw 13 during a pivoting motion of the head 2, 3.

A screwing tool, which is characterized in that the distance between a first torque transmission flank formed by the fixed jaw 13 and a second torque transmission flank 16 formed by the movable jaw 14 is minimal in the pivoting end position.

A screwing tool, which is characterized in that the two heads 2, 3 have different minimal distances between the two torque transmission flanks 15, 16.

A screwing tool, which is characterized in that the two heads 2, 3 are to be displaced from the respective pivoting end position in opposite pivoting directions.

All disclosed characteristics are essential to the invention (individually, but also in combination with one another). The disclosure of the associated/attached priority documents (copy of the priority application) is hereby fully incorporated into the disclosure content of this application, namely also for the purpose of integrating characteristics of these documents into claims of the present application. The characteristics of the dependent claims also characterize independent inventive enhancements of the prior art without the characteristics of a claim to which they refer, particularly for submitting divisional applications on the basis of these claims. The invention specified in each claim may additionally comprise one or more of the characteristics that were disclosed in the preceding description and, in particular, are identified by reference symbols and/or included in the list of reference symbols. The invention also concerns design variations, in which individual characteristics cited in the preceding description are not realized, particularly as far as they are obviously dispensable for the respective intended use or can be replaced with other, identically acting technical means.

The invention claimed is:

1. A screwing tool with an elongate handle, which on each of its two ends carries a head that is pivotable about a pivot axis and respectively forms torque transmission flanks, the distance between which changes during a pivoting motion of the head, with a fixed jaw and a movable jaw, wherein said handle has a force application flank for introducing a force in order to generate a torque on the head lying remotely from the respective force application flank, wherein a narrow side of the fixed jaw, which is functionally directed away from a stop, forms an extension of the force application flank in a pivoting end position of the head, in which the stop of the head lies against a counter stop of the handle, characterized in that the narrow side essentially lies flushly adjacent to the force application flank, in that the head is held in the pivoting end position by means of a spring, in that the counter stop is associated with the handle, and in that the two heads are to be displaced from the respective pivoting end position in opposite pivoting directions.

2. The screwing tool according to claim 1, wherein the two force application flanks are formed by the same narrow side of the handle.

3. The screwing tool according to claim 1, wherein a fixed jaw that is rigidly arranged on the head and a movable jaw that is displaced relative to the fixed jaw during a pivoting motion of the head.

4. The screwing tool according to claim 1, wherein the distance between a first torque transmission flank formed by the fixed jaw and a second torque transmission flank formed by the movable jaw is minimal in the pivoting end position.

5. The screwing tool according to claim 1, wherein the two heads have different minimal distances between the two torque transmission flanks.

* * * * *